United States Patent [19]

Pino

[11] Patent Number: 4,635,443

[45] Date of Patent: Jan. 13, 1987

[54] NON-FOULING ACTUATING MECHANISM

[75] Inventor: Louis Pino, Rego Park, N.Y.

[73] Assignee: EDO Corporation, College Point, N.Y.

[21] Appl. No.: 733,220

[22] Filed: May 10, 1985

[51] Int. Cl.[4] ..... F15B 15/10; F41F 5/02

[52] U.S. Cl. ..... 60/628; 60/593; 89/1.14; 89/1.57

[58] Field of Search ..... 89/1.14, 1.57; 244/137 A; 60/632, 638, 628, 533, 593

[56] References Cited

U.S. PATENT DOCUMENTS

| | | | |
|---|---|---|---|
| 2,575,071 | 11/1951 | Rockwell | 89/1.14 |
| 2,912,902 | 11/1959 | Nessler | 89/1.57 |
| 3,071,930 | 1/1963 | Moulin | 60/533 |
| 3,404,598 | 10/1968 | Angelos | 89/1.14 |
| 3,500,716 | 3/1970 | Schnepfe et al. | 89/1.57 |
| 4,111,221 | 9/1978 | Olsen | 89/1.14 |

*Primary Examiner*—Frederick R. Schmidt
*Assistant Examiner*—Robert A. Rose
*Attorney, Agent, or Firm*—Davis Hoxie Faithfull & Hapgood

[57] ABSTRACT

An intermediate actuating metal bellows filled with a liquid is positioned between an explosive gas cartridge and an actuating piston in an ordnance ejector system. The bellows is miniaturized, light weight and of low spring rate. The liquid in the bellows creates a fluid pressure internal to the bellows equal to the gas pressure external to the bellows, and is of low compressibility, low viscosity, low coefficient of thermal expansion, wide operating temperature range and high thermal conductivity. The fluid-filled bellows transmits gas pressure to the piston but prevents damage to the piston and piston seals from the high-pressure, high-temperature erosive gas. The liquid in the bellows acts as a heat sink to protect the bellows; as a heat insulator reducing heat losses to the piston housing and insulating the piston and piston seals from high temperature; and as a lubricant for the piston and piston seals. Environmental pressures and temperatures of 18,000 psi and 4500° F. can be repeatedly withstood, and less frequent disassembly, cleaning and replacement of system components are required.

12 Claims, 2 Drawing Figures

NON-FOULING ACTUATING MECHANISM

BACKGROUND OF THE INVENTION

The present invention relates to a non-fouling actuating mechanism, for use in aircraft stores ejector rack units and other military ordnance systems, which converts the energy output of a conventional gas combustion cartridge into piston actuated mechanical work.

Present day high performance military aircraft require external stores to be released and displaced at high velocity in order for the stores to properly leave the aircraft aerodynamic flow field. This is generally accomplished by the use of ejector racks or missile launchers and the like, which use as energy sources explosive cartridges that generate high pressure, high temperature gases. The high pressure, high temperature gases generally act on piston-actuated devices involved in bringing about ejection of the stores from the aircraft.

The burning propellants of conventional cartridges generate gases having an operating pressure of up to 18,000 psi and an operating temperature in excess of 4,500° Fahrenheit. Unburned propellant, residue from ignitors, oxides from the cartridge cases and erosion of the breech all create ablative particles which will ultimately foul or jam the piping, actuating pistons, ejector guns and other components of the ejector rack system in the explosive gas train. In addition, the high pressure and temperature, alone and in conjunction with the ablative particles, will rapidly erode the actuating pistons and destroy the piston seals.

In the past, it has been necessary to remove the erosive residue by frequent periodic disassembly and cleaning of the rack and replacement of worn components. Failure to regularly perform this service affected both system operation and reliability. However, frequent disassembly, cleaning and replacement adversely affected both the cost and availability of the equipment.

Attempts have been made to circumvent the problem by developing clean burning cartridges, but with a lack of success to date.

Attempts also have been made to filter the particulates from the high pressure, high temperature gases prior to the time these particulates can act on the actuating pistons and seals. While filters have proven to be beneficial, regular disassembly and cleaning of the system components is still required. And, the finer the filtration, the more frequent the cleaning required.

Attempts also have been considered to utilize a bellows to isolate high pressure, high temperature contaminated gases from moving pistons and seals. However, these attempts have required the use of large, heavy bellows with high spring rates in order to counteract the force of the high pressure, high temperature gases; such bellows are completely inappropriate in size and weight for aircraft ejector racks and other military ordnance systems.

SUMMARY OF THE INVENTION

The present invention provides an intermediate actuating mechanism which prevents the erosive combustion products of a gas cartridge from contacting and contaminating the piston and piston seal components of an ordnance ejector system, to thereby decrease or eliminate component damage, system maintenance and system downtime. In accordance with the present invention, this is achieved by providing a small, light weight, low spring rate, metal bellows filled with a liquid of low compressability and low viscosity and positioned between the piston and gas cartridge in an ordnance ejector system. The liquid-filled bellows isolates the piston from the gas to prevent ablative combustion particles generated by the gas cartridge from fouling the piston, while at the same time allowing the gas pressure to be transmitted to the piston via the liquid. The liquid in the bellows permits the miniaturization of the bellows required for use in aircraft stores ejector racks and the like, the liquid creating a fluid pressure internal to the bellows equal to the gas pressure external to the bellows and thereby permitting a viable design for such ordnance use. The isolating bellows further eliminates gas leakage and pressure drops past the piston seals, and eliminates ablative and erosion damage to the piston and piston seals. The present invention accordingly will operate repeatedly and reliably under environmental pressures and temperatures of up to 18,000 psi and in excess of 4,500° Fahrenheit, respectively. The liquid in the bellows also acts as a heat sink to protect the bellows; as a heat insulator reducing heat losses to the piston housing and insulating the piston and piston seals from high temperature; and, as a lubricant for the piston and piston seals.

Other details and advantages of the present invention will be understood from the drawings and following detailed description.

DETAILED DESCRIPTION OF INVENTION

Figure 1:
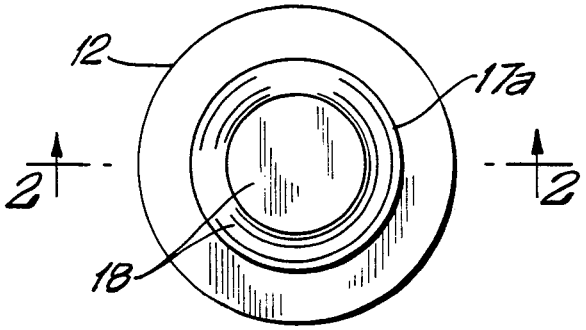
FIG. 1 is a plan view of the subject invention.

Referring to the drawings, 10 represents diagrammatically the closed breech of an aircraft stores ejector rack, it being understood that various breech designs are well-known in the art.

Within the breech 10, there is shown a conventional gas cartridge 11 which is a source of high-temperature, high pressure gas 11*a* containing erosive combustion products. Also within breech 10 is a piston housing 12 having a piston chamber opening 13 therein and containing piston 14. Positioned within the peripheral wall of, and movable with, piston 14 are high pressure seal 15 and anti-extrusion back-up ring 16.

A closed-system, energy transmitting, intermediate actuating means is further contained within breech 10 and serves to isolate piston 14 and sealing means 15,16 from the gas 11*a*. The intermediate actuating means is comprised of thin, contractible, flexible metal bellows 17 which may be formed of stainless steel and has a low spring rate, small size and light weight. Bellows 17 is hermetically welded in sealing relationship at one end 17*a* about its circumferential periphery to imperforate metal bellows cap 18, which may be formed of stainless steel, and is hermetically welded at its other end 17*b* in sealing relationship about its circumferential periphery to piston housing 12 so as to completely surround piston chamber 13. The sealing weldings at bellows ends 17*a* and 17*b* prevent any of gas 11*a* from entering interior to the bellows 17. Contained within bellows 17, and filling the bellows 17 between bellows cap 18 and piston 14, is a liquid 19 of low compressibility, low viscosity, low coefficient of thermal expansion, wide operating temperature range and high thermal conductivity. The sealing means 15,16 prevent the loss of liquid 19 past the piston 14.

Abutting and restraining piston 14 at its lower end is for example the locking mechanism 20 of an aircraft stores ejector rack, such mechanisms being well-known and serving to lock stores onto the rack until discharge is desired. Connected to bellows cap 18 is a linkage 21 which is connected to a valving vent 22 in breech 10.

Ignition of a gas cartridge 11 generates the high pressure, high temperature gas together with the erosive combustion particles. The high temperature, high pressure gas and combustion particles 11*a* will envelop and act upon the external surface of bellows cap 18 and bellows 17. With the piston 14 restrained by the locking mechanism 20, the internal pressure of the intermediate liquid 19 will follow and match the rising external pressure of the gas 11*a*. The intermediate fluid 19 thereby creates a fluid pressure internal to the bellows 17 which is equal to the gas pressure external to the bellows 17, thereby maintaining a pressure differential of zero between the internal and external surfaces of the bellows 17.

Figure 2:
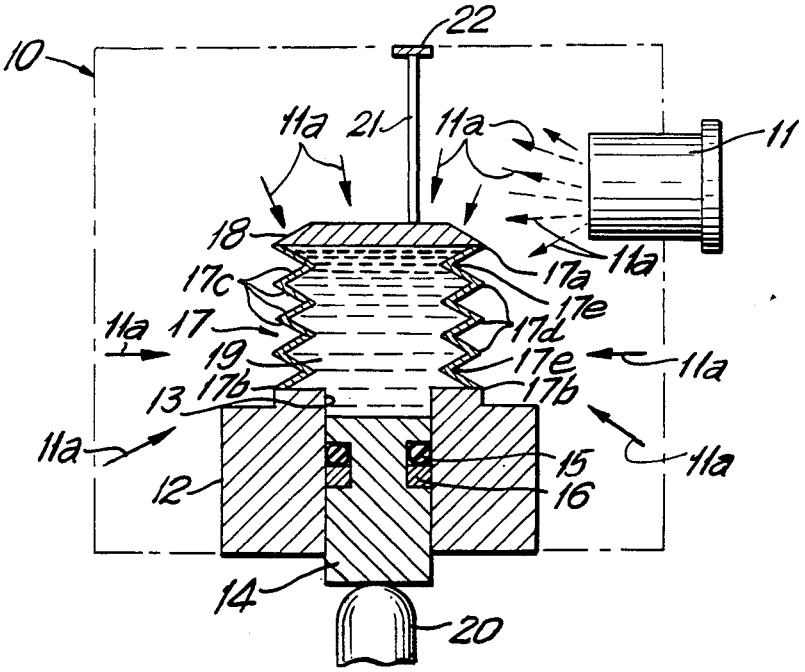
FIG. 2 is a diagrammatic cross-sectional view of the invention taken along lines 2—2 of FIG. 1.

The internal fluid pressure continues to match the external gas pressure until the increase in the fluid pressure on piston 14 overcomes the restraining force of mechanism 20. The gas pressure acting externally on the bellows 17 is thereby transmitted by the intermediate fluid 19 to the actuating piston 14 until piston 14 actuates mechanism 20 to unlock the store carried by the ejector rack. Thereafter, the movement of bellows cap 18 in a lower direction toward piston housing 12, as the bellows 17 axially contracts, operates through linkage 21 to open valving vent 22 and allow gas 11*a* in the breech to discharge through vent 22 and accelerate the unlocked store away from the aircraft. Upon loading a new store onto the ejector rack, the various parts are returned to the position shown in FIG. 2.

It will be recognized that the bellows 17 and bellows cap 18 comprise a barrier which hermetically seals the ablative high temperature gases and erosive combustion products 11*a* from the other components of the system. This barrier eliminates sticking or jamming of the sliding actuating piston 14, normally caused by high temperature erosive combustion particles 11*a*, by preventing said particles from coming in contact with the piston 14 or sealing means 15,16. In addition, by separating the gas from the actuating piston 14, the barrier eliminates loss of gas and gas pressure past the piston sealing means 15,16, prevents ablative damage to the piston sealing means 15,16, and minimizes the loss of gas heat through conduction. Aircraft ejector racks and other military ordnance systems which utilize the present invention will therefore operate more efficiently, require less maintenance and will be more reliable than existing systems.

The metal bellows 17 is of primary significance in the present invention, in that the bellows shape is found to be particularly adapted to providing a minimum volume-maximum contracting stroke actuating means in the breech of the ejector rack. The bellows shape also retains its shape integrity as it contracts (folds) under the gas pressure to operate piston 14, and contracts axially in the desired direction of the force to be applied to piston 14. A non-limiting example embodiment of a suitable bellows may be comprised of a plurality of stainless steel plates (either flat or of nesting configuration) 17*c*, each 0.002 inches thick and welded to each other at outer and inner diameters 17*d* and 17*e*; bellows outer and inner diameters of 0.953 and 0.593 inches respectively; a free state bellows height of 0.535 inches; a closed bellows height of 0.218 inches; a nominal bellows stroke of 0.165 inches; and a bellows spring constant of approximately 10 lbs. per inch.

The intermediate liquid 19 also is of primary significance in the present invention, allowing the bellows internal pressure to be equalized with the bellows external pressure and thereby minimizing working stress during bellows operation and in turn allowing the use of a miniaturized, thin-walled, light weight, low spring rate bellows suitable for aircraft ordnance systems. The liquid 19 also functions as a heat sink for the bellows 17, protecting the bellows 17 from destruction by the ablative high temperature gases 11*a*. At the same time, the liquid 19 also functions as a heat insulator, reducing heat loss to the piston housing 12 and insulating the actuating piston sealing means 15,16 from high temperatures. In addition, the liquid 19 acts as a lubricant for the actuating piston 14 and sealing means 15,16. Liquids usable in accordance with the present invention to meet the various criteria described hereinabove include the material sold under the trademark "Dow Corning 510 Fluid" by Dow Corning Corporation, which is a heat-stable silicone fluid typically having a standard nominal viscosity of 50 centistokes at 77° Fahrenheit; a percent compressibility of approximately 2.85 at 5000 psi and 7.95 at 20,000 psi; a coefficient of expansion of 0.00096 cc/cc/degree C. from 0 to 100 degrees C.; and a thermal conductivity of 0.00035 gm-cal/sec/cm$^2$/degree C. differential for 1-cm thickness.

The design, construction and materials of the present invention enable ordnance actuating systems to operate efficiently and repeatedly in a hostile environment of erosive combustion products, gas temperature exceeding 4,500° Fahrenheit and operating pressures ranging up to 18,000 psi. The mechanism may be operated many times without being fouled or jammed by combustion products. In the event of a failure of the locking mechanism 20 to unlock, the intermediate actuating means will withstand a pressure in the range of 30,000 psi without detrimental effect.

It is understood that various changes and modifications may be made in the foregoing without departing from the spirit and scope of the invention as hereinafter claimed. For example, while the preferred embodiment of the present invention is described for use in conjunction with a pyrotechnic gas generator as the input source, the present invention is applicable to other forms of gas or fluid energy sources, and may be used with energy sources having a variety of temperatures or pressures. Likewise, although the preferred embodiment of the present invention describes an operating mechanism which utilizes a piston, the present invention is adaptable to other forms of both linear and rotating operating mechanisms.

What is claimed is:

1. Means for use in converting the energy of a pressure generating gas to mechanical work, comprising in combination a piston housing having a piston chamber opening therein; a piston contained within the piston chamber; a closed-system, energy-transmitting, intermediate actuating means isolating said piston from said pressure generating gas; the intermediate actuating means comprising a flexible metal bellows having a low spring rate, a bellows cap, means sealing the bellows at one end about its periphery to the bellows cap, means sealing the bellows at its other end about its periphery to the piston housing at a position to surround the piston chamber opening, and a liquid of low compressibility contained within and filling the bellows between the bellows cap and the piston; said liquid creating a fluid pressure within the bellows equal to the gas pressure external to the bellows; whereby, when sufficient gas pressure acts upon the bellows it causes the bellows to contract and the liquid of low compressibility within the bellows to act against the piston.

2. The invention of claim 1, further including a gas source for delivering a high-temperature, high-pressure erosive gas to the exterior of the metal bellows and bellows cap, the intermediate actuating means isolating the piston from the ablative effects of the gas.

3. The invention of claim 2, wherein the metal bellows has a light weight and miniaturized size suitable for use in an aircraft stores ejector rack or the like and operable at pressures and temperatures up to 18,000 psi and in excess of 4500° F., respectively.

4. The invention of claim 2, wherein the intermediate actuating means is mounted within the breech of an aircraft stores ejector rack or the like.

5. The invention of claim 4, wherein the piston is operatively connected with the locking mechanism of an aircraft stores ejector rack or the like and the bellows cap is operatively connected with valving means to vent the high-temperature, high-pressure gas to discharge the aircraft stores ejector rack or the like, whereby the gas delivered to the bellows moves the bellows cap toward the piston and operates the piston via the bellows-contained liquid to unlock the locking mechanism, and the movement of the bellows cap in turn opens the valving means to discharge the aircraft stores ejector rack or the like.

6. The invention of claim 1, wherein the liquid is of low viscosity.

7. The invention of claim 2, wherein the liquid is of low viscosity, low coefficient of thermal expansion, wide operating temperature range and high thermal conductivity.

8. The invention of claim 1, wherein the bellows is a thin member comprised of stainless steel.

9. The invention of claim 8, wherein the bellows is sealed at its opposite ends by welding to the bellows cap and piston housing respectively.

10. The invention of claim 1, wherein sealing means seal the piston periphery and piston housing with respect to each other to prevent flow of the liquid within the bellows past the piston.

11. The invention of claim 10, wherein the sealing means comprises a sealing ring and a back-up ring mounted within the peripheral wall of, and movable with, the piston.

12. The invention of claim 1, wherein the bellows is comprised of a plurality of thin metal plates welded to one another at the inner and outer diameters of the bellows, and the liquid is a heat-stable silicone fluid.

* * * * *